US009957129B2

(12) United States Patent
Chandaria et al.

(10) Patent No.: US 9,957,129 B2
(45) Date of Patent: May 1, 2018

(54) TAPE DISPENSER WITH CUTTER ASSEMBLY AND PROTRUSION

(71) Applicant: Kitaru Innovations Inc., Warrens, St. Michael (BB)

(72) Inventors: Kapoor Chandaria, Nairobi (KE); Kumud Shah, Nairobi (KE)

(73) Assignee: Kitaru Innovations Inc., Warrens, St. Michael (BB)

( * ) Notice: Subject to any disclaimer, the term of this patent is extended or adjusted under 35 U.S.C. 154(b) by 179 days.

(21) Appl. No.: 14/918,158

(22) Filed: Oct. 20, 2015

(65) Prior Publication Data

US 2016/0039628 A1 Feb. 11, 2016

Related U.S. Application Data

(62) Division of application No. 13/533,512, filed on Jun. 26, 2012, now Pat. No. 9,199,819.

(51) Int. Cl.

| | |
|---|---|
| ***B26F 3/02*** | (2006.01) |
| ***B26F 3/00*** | (2006.01) |
| ***B65H 35/00*** | (2006.01) |
| ***B65H 35/10*** | (2006.01) |

(52) U.S. Cl.

CPC ..... *B65H 35/008* (2013.01); *B65H 35/0026* (2013.01); *Y10T 225/222* (2015.04); *Y10T 225/269* (2015.04); *Y10T 225/298* (2015.04)

(58) Field of Classification Search

CPC ..... B65H 35/0026; B65H 35/008; Y10T 225/298; Y10T 225/222; Y10T 225/269

USPC ..... 225/1, 42, 46, 96, 106, 19, 25; 83/648–650; 242/348, 348.1, 348.2, 242/348.4, 55, 588.3, 588.6, 588.5

See application file for complete search history.

(56) References Cited

U.S. PATENT DOCUMENTS

| | | | | |
|---|---|---|---|---|
| 1,794,205 | A * | 2/1931 | Ridderstrom | B26D 1/0006 225/91 |
| 2,640,656 | A * | 6/1953 | Donkin | B65H 35/0026 225/25 |
| 2,975,950 | A * | 3/1961 | Kusek | B65H 35/0026 225/26 |
| 3,500,517 | A | 3/1970 | Dekker et al. | |
| 3,567,087 | A * | 3/1971 | Schramm | A47K 10/38 225/43 |
| 3,638,522 | A | 2/1972 | Balli | |
| 3,725,182 | A | 4/1973 | Regan | |
| 3,855,892 | A | 12/1974 | DiLello et al. | |

(Continued)

*Primary Examiner* — Ghassem Alie
*Assistant Examiner* — Bharat C Patel
(74) *Attorney, Agent, or Firm* — Sand & Sebolt

(57) ABSTRACT

A cutter assembly suitable for cutting BOPP adhesive tape and a tape dispenser incorporating the same. The cutter assembly has a row of plastic teeth where each tooth includes left and right front and rear faces, each face being disposed on a different plane, and where the planes intersect each other at the tip of the tooth. A front edge extends between the left and right front faces; a rear edge extends between the left and right rear faces; a left side edge extends between the right front and rear faces; and a right side edge extends between the left front face and the right rear face. The various edges are set at particular angles relative to each other. A protrusion for supporting the tape is provided rearwardly of the teeth and a braking mechanism is also provided on the dispenser.

19 Claims, 8 Drawing Sheets

(56) References Cited

U.S. PATENT DOCUMENTS

| | | | | |
|---|---|---|---|---|
| 4,351,210 | A * | 9/1982 | McKindary | B26F 1/44 30/355 |
| 4,426,029 | A | 1/1984 | Kamp | |
| 4,450,996 | A | 5/1984 | Kamp | |
| 4,506,816 | A * | 3/1985 | Roccaforte | B23P 15/40 225/48 |
| 4,852,442 | A | 8/1989 | Pottorff | |
| 4,913,767 | A | 4/1990 | Longworth | |
| 5,073,228 | A | 12/1991 | Lin | |
| 5,445,703 | A | 8/1995 | Steeves et al. | |
| 5,472,560 | A | 12/1995 | Horng | |
| 5,706,993 | A | 1/1998 | DeMatteis | |
| 6,367,533 | B1 | 4/2002 | Pitzen | |
| 6,375,058 | B1 | 4/2002 | Passamoni | |
| 6,386,416 | B1 | 5/2002 | Dunshee et al. | |
| 6,497,263 | B1 | 12/2002 | Pitzen | |
| 6,612,474 | B2 * | 9/2003 | Shah | B65H 35/0026 156/577 |
| 6,797,375 | B1 | 9/2004 | Pearson et al. | |
| 7,066,367 | B2 | 6/2006 | Chandaria et al. | |
| 7,175,062 | B2 | 2/2007 | Shah | |
| 7,186,458 | B2 * | 3/2007 | Pearson | B32B 7/12 428/343 |
| 2004/0088869 | A1 | 5/2004 | Lock | |
| 2004/0151901 | A1 | 8/2004 | Pearson et al. | |
| 2011/0036058 | A1 * | 2/2011 | Howdeshell, II | B26D 1/0006 53/419 |

* cited by examiner

TAPE DISPENSER WITH CUTTER ASSEMBLY AND PROTRUSION

CROSS-REFERENCE TO RELATED APPLICATION

This is a Divisional of U.S. patent application Ser. No. 13/533,512 filed Jun. 26, 2012, the entire specification of which is incorporated herein by reference.

BACKGROUND OF THE INVENTION

Technical Field

This invention relates generally to hand-held tape dispensers. More particularly, this invention relates to a hand-held dispenser for adhesive tape of the sort which is used for ordinary household and office purposes. Specifically, this invention is directed to a tape dispenser which has an improved plastic cutter assembly for severing BOPP (Biaxially-Oriented Polypropylene) adhesive tape, a protrusion for supporting a first region of the tape when a second region thereof is being severed, and a brake mechanism for halting rotation of the tape roll.

Background Information

Adhesive tape is commonly used in households and offices to secure articles together. Typically, this tape is between 1 and 2 cm in width. For the purposes of the present invention, this type of adhesive tape will be referred to as "household tape". Household tape is generally sold and available in two formats: in rolls that are typically sold in boxes or already installed in small handheld tape dispensers. In North America, the majority of the household tapes in use are made using two different film substrates, namely, acetate and BOPP (Biaxially-Oriented Polypropylene).

Acetate film includes a backing of cellulose acetate, which comes from wood pulp and/or cotton fibers, treated with acetic acid and anhydride. One side of the film is treated with a release agent. The construction of the film is very brittle and it has very poor pull strength; therefore, the slightest incision in the substrate tends to tear the film apart. There are few commercial sources of this film in the world and it is, therefore, a relatively expensive raw material. Furthermore, to minimize the naturally higher risk of breaking the web of film, causing exorbitant wastage rates in production, during the coating and converting processes, both activities are managed at a very slow pace.

By contrast, BOPP film is manufactured using an extrusion process. The extruded film is stretched significantly from a 1 meter width (±39") at extrusion to a 9 meter wide (±354") finished roll. Such film is not brittle and does not tear easily, usually requiring a sharp blade to incite a tear. The 9 meter wide roll is slit into smaller manageable widths ranging from 1.27 meter (50") to 2 meters (79"), to accommodate desired machine capacities. BOPP is manufactured much more widely and efficiently, therefore, it is a much more cost-effective film to procure while generating significantly more manageable wastage levels.

To facilitate the increased penetration of good quality BOPP film in North American household tapes in recent years, metal cutters have been installed in the cutters of the typical hand-held tape dispensers to ensure a satisfactory experience for the consumer. The increased strength of the film makes it more difficult to cut and the metal cutters have proven to be more successful at accomplishing this task than previous plastic cutters. Until the development of the present invention, which shall be described hereinafter, nobody has successfully designed a hand-held tape dispenser that includes plastic teeth which can tear BOPP adhesive film without compromising the film's performance. In those instances where BOPP film is able to tear on a plastic cutter, the actual film has had to be modified during the converting process by serrating the film's edges using a special knife, a process termed score-cutting. Though this ensures that the user is more easily able to dispense the tape on a plastic cutter, this type of tape product tends to fail industry tests under normal laboratory conditions with respect to tensile strength and elongation.

U.S. Pat. No. 6,612,474 discloses a hand-held tape dispenser that is suitable for dispensing acetate type adhesive tapes. U.S. Pat. No. 6,612,474 is assigned to the same assignee as the present matter. In the tape dispenser disclosed in U.S. Pat. No. 6,612,474, the teeth on the plastic cutter have a relatively small height as it does not take much to tear the acetate tape when dispensing the product. However, this same patented dispenser is less able to consistently and satisfactorily dispense BOPP adhesive tape as this type of tape tends to stretch on the teeth instead of being cut thereby.

There is therefore a need in the art for a tape dispenser including a plastic cutter assembly that is able to more consistently and satisfactorily dispense BOPP-based adhesive tapes.

BRIEF SUMMARY OF THE INVENTION

The device of the present invention is a tape dispenser which incorporates a cutter that is able to consistently and satisfactorily dispense BOPP-based adhesive tapes. In this tape dispenser, the teeth on the cutter assembly remain below the height of the shields on each side of the cutter assembly. This arrangement ensures that the user will be less likely to scratch themselves while dispensing tape. The configuration of the teeth on the cutter is substantially different to the configuration of the teeth in the dispenser covered by U.S. Pat. No. 6,612,474. Specifically, the teeth on the cutter assembly of the present invention include four faces that join each other along edges that are disposed at particular angles relative to each other. Additionally, the teeth of the present invention have edges that join the faces that cause the teeth to be longer in overall height that the previously known teeth.

Additionally, the device of the present invention includes a protrusion positioned rearwardly of the cutter assembly and between the cutter assembly and the axles that support the roll of tape. This protrusion allows the tape to rest thereon when a desired length of the tape is being dispensed. The dispenser further includes a braking mechanism which allows the user to cause the rotation of the tape roll to cease and to be held in a particular position before the tape is severed by the cutter assembly. The combination of the braking mechanism, the unique design of the teeth, and the protrusion before the cutter, all work together to ensure that BOPP adhesive tape can be successfully dispensed.

The tape dispenser in accordance with the present invention has the capability to successfully tear three types of BOPP film, namely, lustre film, matte film and clear film. Matte BOPP is used to manufacture invisible tapes and has a hazy or slightly opaque finish while the clear BOPP tape is crystal clear with a haze factor of 2% or less. In both instances, the dispenser is designed to function with films of 1.0 Mil (25 microns) thickness. The total thickness of the product generally dispensed on the tape dispenser of the present invention is 2.0 Mil (50 microns), i.e., 1.0 Mil or 25 microns of BOPP film and 1.0 or 25 microns of adhesive.

Thus, in accordance with the present invention, a cutter assembly suitable for cutting BOPP adhesive tape and a tape dispenser incorporating the same is disclosed. The cutter assembly has a row of plastic teeth where each tooth includes left and right front and rear faces, each face being disposed on a different plane, and where the planes intersect each other at the tip of the tooth. A front edge extends between the left and right front faces; a rear edge extends between the left and right rear faces; a left side edge extends between the right front and rear faces; and a right side edge extends between the left front face and the right rear face. The various edges are set at particular angles relative to each other. A protrusion is provided rearwardly of the row to teeth to support a first region of the tape when a second region is being severed by the teeth. A braking mechanism is also provided on the dispenser to stop rotation of the tape roll during dispensing of the tape.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
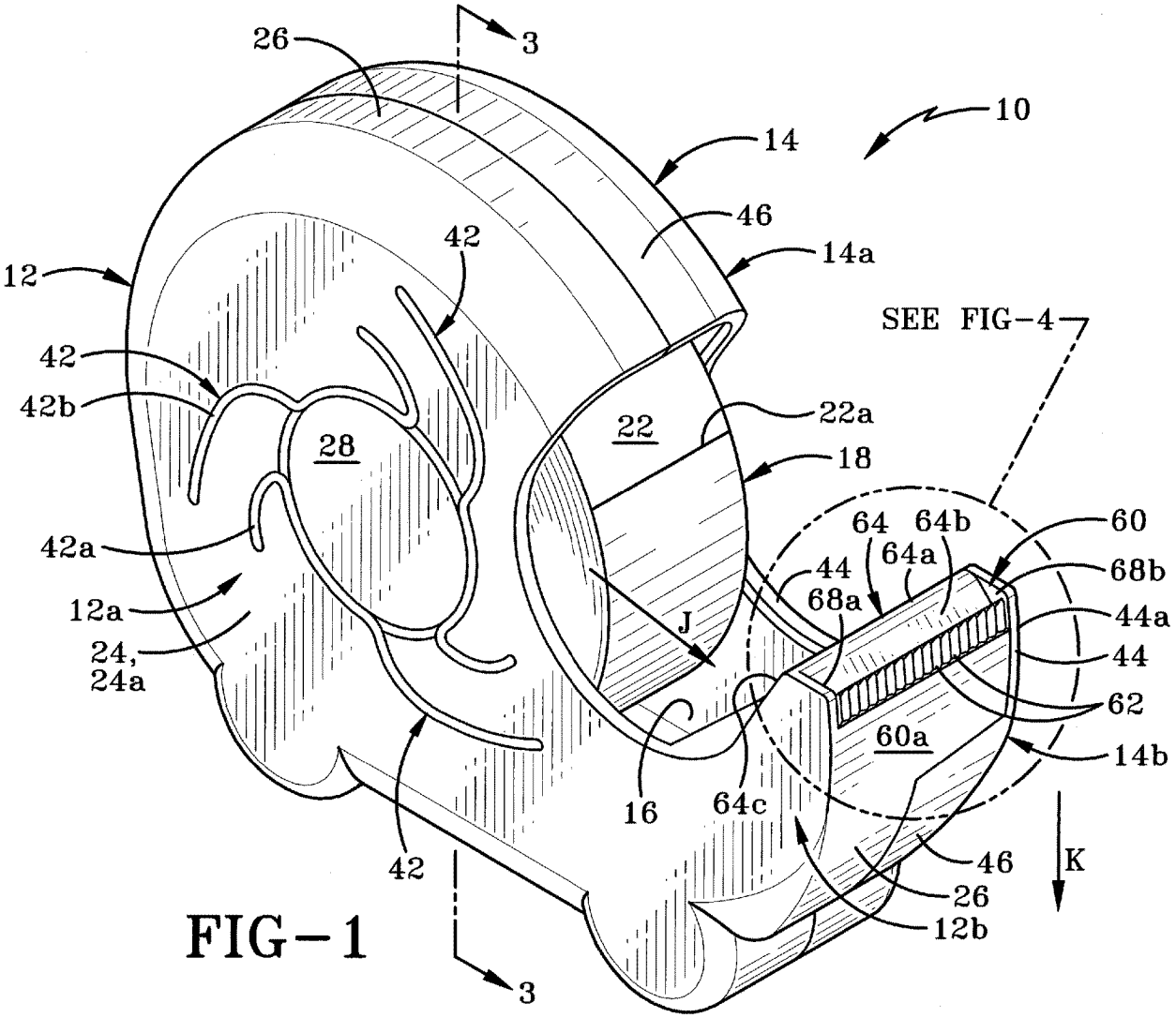
FIG. 1 is a perspective view of a tape dispenser in accordance with the present invention.
Figure 2:
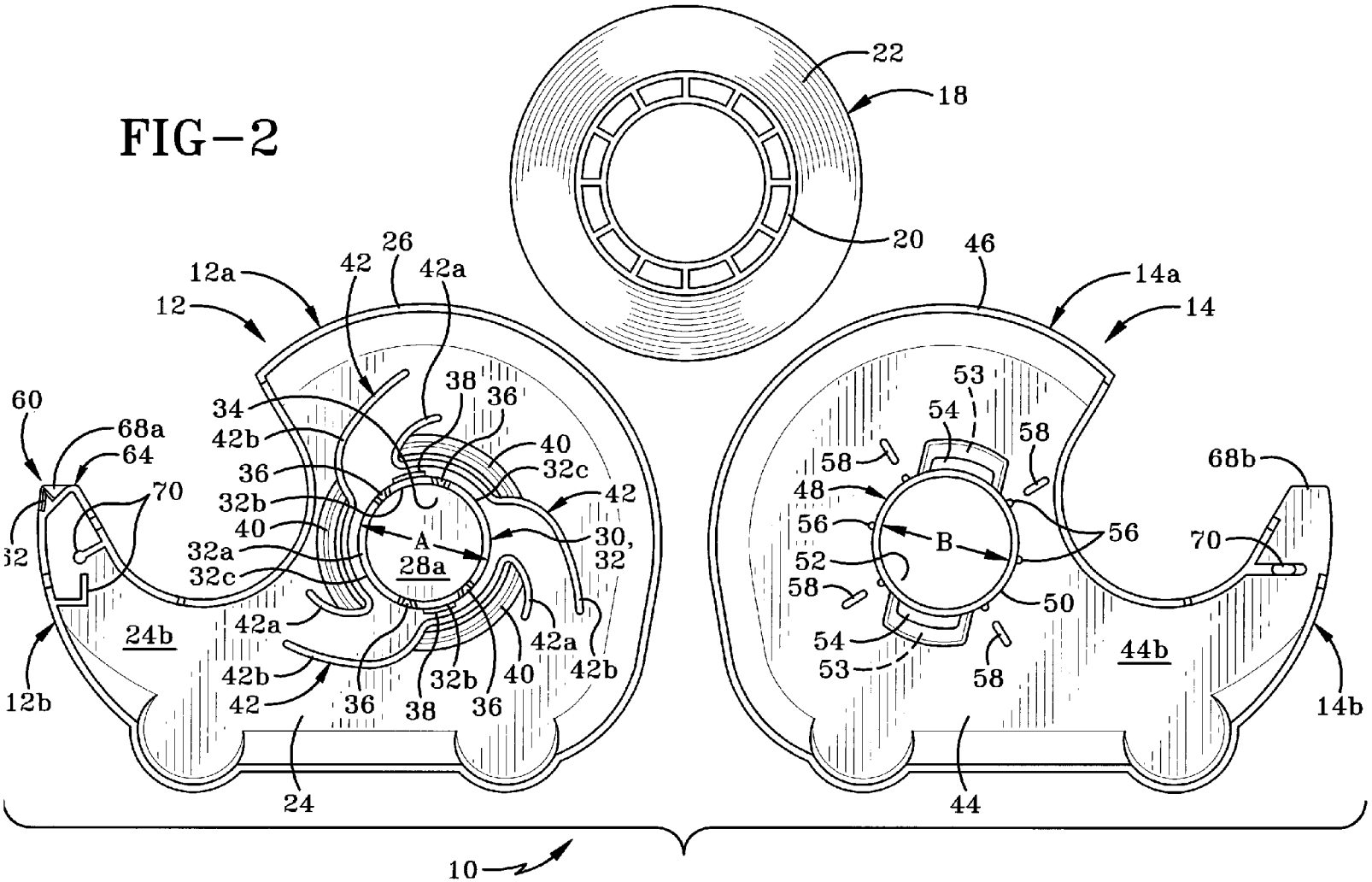
FIG. 2 is an exploded view of the tape dispenser showing a first side member, a second side member and the roll of tape.

Referring to FIGS. 1-8 there is shown a hand-held tape dispenser in accordance with the present invention and generally indicated by the reference number 10. Tape dispenser 10 comprises a first side member 12 and a second side member 14 that are engaged with each other to define an interior cavity 16 within which is housed a roll 18 of adhesive tape. As indicated previously, dispenser 10 is especially suitable for dispensing BOPP adhesive tape. As best seen in FIG. 2, roll 18 comprises a circular hub 20 made from a suitable material, such as plastic, and around which a length of BOPP adhesive tape 22 is wound. Roll 18 is configured so that it will rotate about an axis that extends through the center of hub 20 in order to dispense sections of tape 22 therefrom.

First side member 12 of dispenser 10 comprises a side wall 24 and a peripheral wall 26. Peripheral wall 26 is disposed generally at right angles to side wall and extends inwardly for a distance therefrom. Side wall 24 forms the side of first side member 12 and peripheral wall 26 forms a top, bottom, front and back wall thereof. Side wall 24 and peripheral wall 26 bound and define approximately one half of cavity 16.

Figure 3:
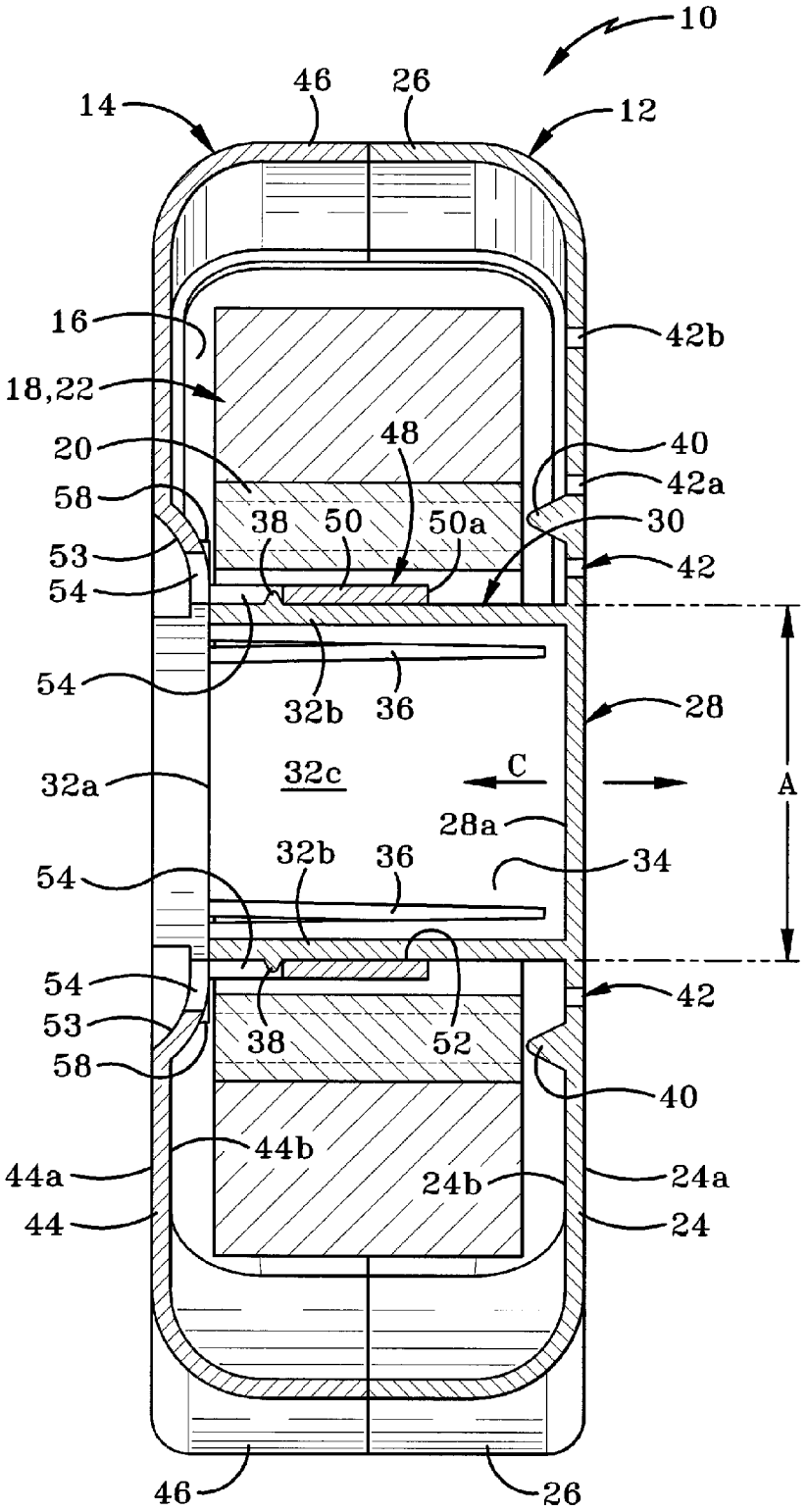
FIG. 3 is a cross-sectional rear view of the tape dispenser taken through line 3-3 of FIG. 1.

Referring to FIGS. 1-3, side wall 24 of first side member 12 has an exterior surface 24*a* and an interior surface 24*b*. Exterior surface 24*a* is provided with a central region 28 that is substantially planar and suitable for positioning one of a forefinger and thumb of a user thereon. A cylindrical first axle portion 30 (FIG. 2) extends inwardly from interior surface 24*b* disposed opposite central region 28. First axle portion 30 is disposed generally at right angles to interior surface 24*b*. First axle portion 30 is of a first external diameter "A". First axle portion 30 comprises a perimeter wall 32 that originates proximate interior surface 24*b* of side wall 24 and extends outwardly therefrom, terminating in an outermost edge 32*a*. Perimeter wall 32 and the interior region 28*a* of central region 28 bound and define a cavity 34 therein. Perimeter wall 32 is not circumferentially continuous in that it defines four longitudinal slots 36 therein. As best shown in FIG. 3, each slot 36 is widest proximate outermost edge 32*a* of perimeter wall 32 and tapers in a direction extending toward interior region 28*a*. Slots 36 are in communication with cavity 34 and are arranged in pairs. Each pair of slots 36 defines a first region 32*b* of perimeter wall 32 between them and the adjacent pairs of slots 36 define second regions 32*c* of perimeter wall 32 between them. The two first regions 32*b* are disposed opposite one another and the two second regions 32*c* are disposed opposite one another. Preferably, each second region 32*c* is larger in area than each first region 32*b*. A detent 38 is provided on an exterior surface of each of first regions 32*b*. Detent 38 is disposed a short distance inwardly from outermost edge 32*a* of perimeter wall 32 and runs substantially circumferentially on first region 32*c*.

In accordance with a specific feature of the present invention, a reinforcing ridge 40 is provided on interior surface 24*b*. Reinforcing ridge 40 is disposed a short distance away from perimeter wall 32 of first axle portion 30 and is disposed substantially parallel thereto. A plurality of channels 42 is defined in first side member 12, with each channel 42 extending between the exterior and interior surfaces 24*a*, 24*b* of side wall 24. Each channel 24 radiates outwardly from proximate perimeter wall 32 in an arcuate fashion. Channels 42 are arranged in pairs, with each pair including a shorter arcuate channel 42*a* and a longer arcuate channel 42*b*. The pairs of channels 42 are radially spaced from each other. The channel pairs cut through ridge 40 and ridge 40 is absent from the region between the shorter and longer channels 42*a*, 32*b* of each pair. Channels 42 are provided to give side wall 24 sufficient flexibility so as to enable central region 28 to be deflected somewhat inwardly toward second side member 14 upon application of pressure thereto, as will be hereinafter described.

Still referring to FIG. 2, second side member 14 comprises a side wall 44 and a peripheral wall 46 which extends inwardly from the side wall 24 and generally at right angles thereto. Side wall 44 forms the side of second side member 14 and peripheral wall 46 forms a top, bottom, front and back portion of second side member 14. Side wall 44 and peripheral wall 46 bound and define approximately one half of cavity 16, with side wall 24 and peripheral wall 26 of first side member 12 bounding and defining the other half of cavity 16, as previously described and illustrated in FIG. 3.

Side wall 44 of second side member 12 has an exterior surface 44*a* (FIG. 3) and an interior surface 44*b*. Exterior surface 44*a* is substantially planar. A cylindrical second axle portion 48 extends outwardly from interior surface 44*b* of side wall 44. Second axle portion 48 includes a perimeter wall 50 that originates at interior surface 44*b* and terminates at an outermost end 50*a*. Perimeter wall 50 of second cylindrical axle portion 48 bounds and defines a bore 52 that is of a second diameter "B". Diameter "B" is greater than diameter "A" of first axle portion 30 and first axle portion 30 is able to be received within bore 52 of second axle portion 48 when first and second sides 12, 14 are joined together. A pair of opposed apertures 54 are defined partially in side wall 44 and partially in perimeter wall 50. Depressions 53 are provided adjacent apertures 54 to aid in correctly positioning the user's finger or thumb during application of the brake mechanism, i.e., when the user compresses first and second side members 12, 14 toward each other. When first and second side members 12, 14 are engaged, detents 38 on first axle portion 30 are received through the apertures 54, specifically those portions of the apertures 54 defined on perimeter wall 50. This situation is illustrated in FIG. 3. The interlocking engagement of detents 38 in apertures 54 holds first and second side members 12, 14 together. Detents 38 prevent first axle portion 30 and second axle portion 48 from accidentally disengaging from each other. It will be understood, however, that dispenser 10 may be manufactured so that first and second side members 12, 14 can be separated from each other to replace roll 18 when tape 22 thereon is finished. In that instance, it is possible to disengage detents 38 from apertures 54.

A plurality of ribs 56 extend longitudinally along an exterior surface of perimeter wall 50 from proximate interior surface 44*b* of side wall 44 to outermost end 50*a*. The interior surface 20*a* of hub 20 contacts ribs 56 as roll 18 rotates about second axle portion 48.

One or more brake spokes 58 extend inwardly from interior surface 44*b* of side wall 44 and into cavity 16. When tape 22 is to be dispensed from roll 18, the user will pull a sufficient length of tape 22 from roll 18 and will then squeeze first and second side members 12, 14 together by compressing the central region 28 and side wall 44 opposite central region 28 toward each other between their thumb and forefinger. This compressive force causes first axle portion 30 to slide inwardly deeper into bore 52 of second axle portion 48 in the direction of arrow "C" (FIG. 3). This movement causes hub 20 of roll 18 to be compressed between ridges 40 on the interior surface 24*b* of first side wall 24 proximate central region 28 and brake spokes 58, causing all rotational motion of roll 18 to cease. The length of tape 22 extending outwardly from the roll 18 at that point can be severed from roll 18 as will be hereinafter described.

Referring to FIG. 1, first side member 12 is generally comprised of a major side region 12*a* and a minor side region 12*b* and second side member 14 is comprised of a major side region 14*a* and a minor side region 14*b*. When first and second side members 12, 14 are engaged with each other, major side region 12*a* of first side member 12 is disposed opposite major side region 14*a* of second side member 14, and minor side region 12*b* of first side member 12 is disposed opposite minor side region 14*b* of second side member 14. Roll 18 of tape 22 is retained between major side regions 12*a*, 14*a* of first and second sides 12, 14 and a cutter assembly 60, in accordance with the present invention, is retained between minor side regions 12*b*, 14*b*.

Cutter assembly 60 is shown in greater detail in FIGS. 4-8. Cutter assembly 60 is provided at a front end of first side member 12 and essentially is formed as an integral part of peripheral wall 26. Cutter assembly 60 extends outwardly from side wall 24 and at right angles thereto. Unlike the rest of peripheral wall 26, however, cutter assembly 60 extends for a sufficient distance outwardly from side wall 24 so as to span the entire gap between side wall 24 and side wall 44 of second side member 14 when first and second side members 12, 14 are engaged with each other. (The rest of peripheral wall 26 extends only about half way across the gap between side walls 24 and 44.)

Figure 4:
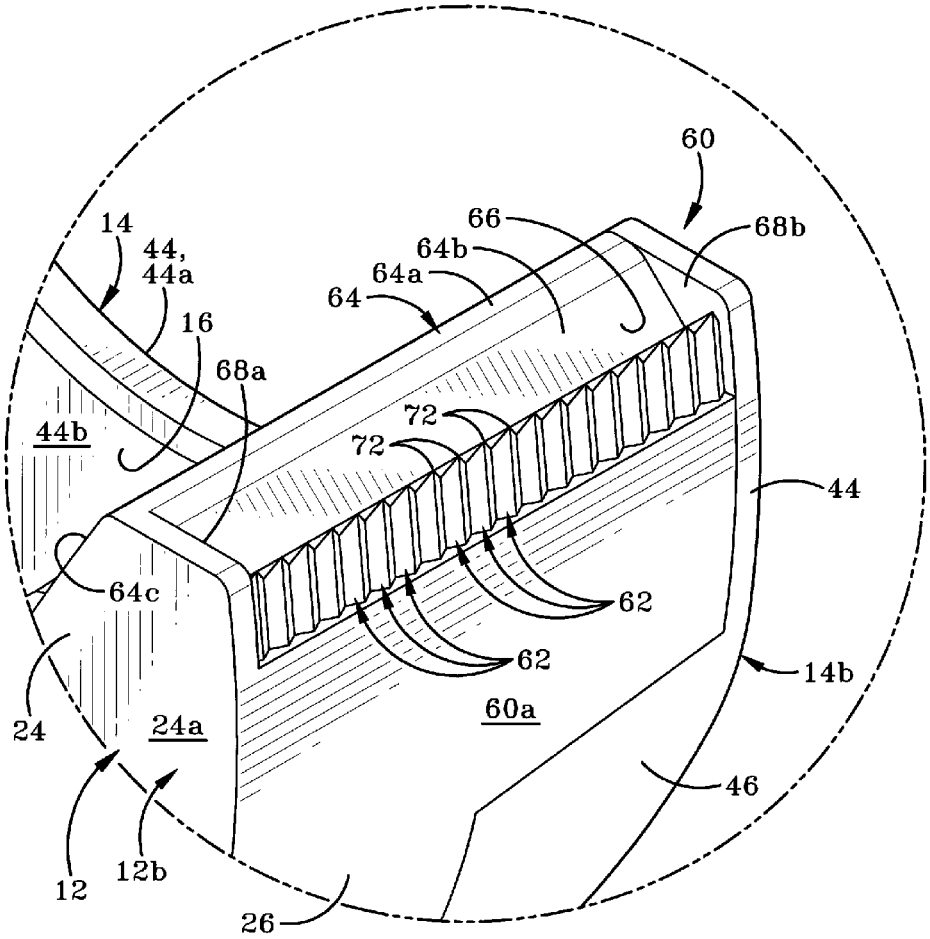
FIG. 4 is an enlarged perspective view of the cutter assembly taken from the highlighted region of FIG. 1.
Figure 5:
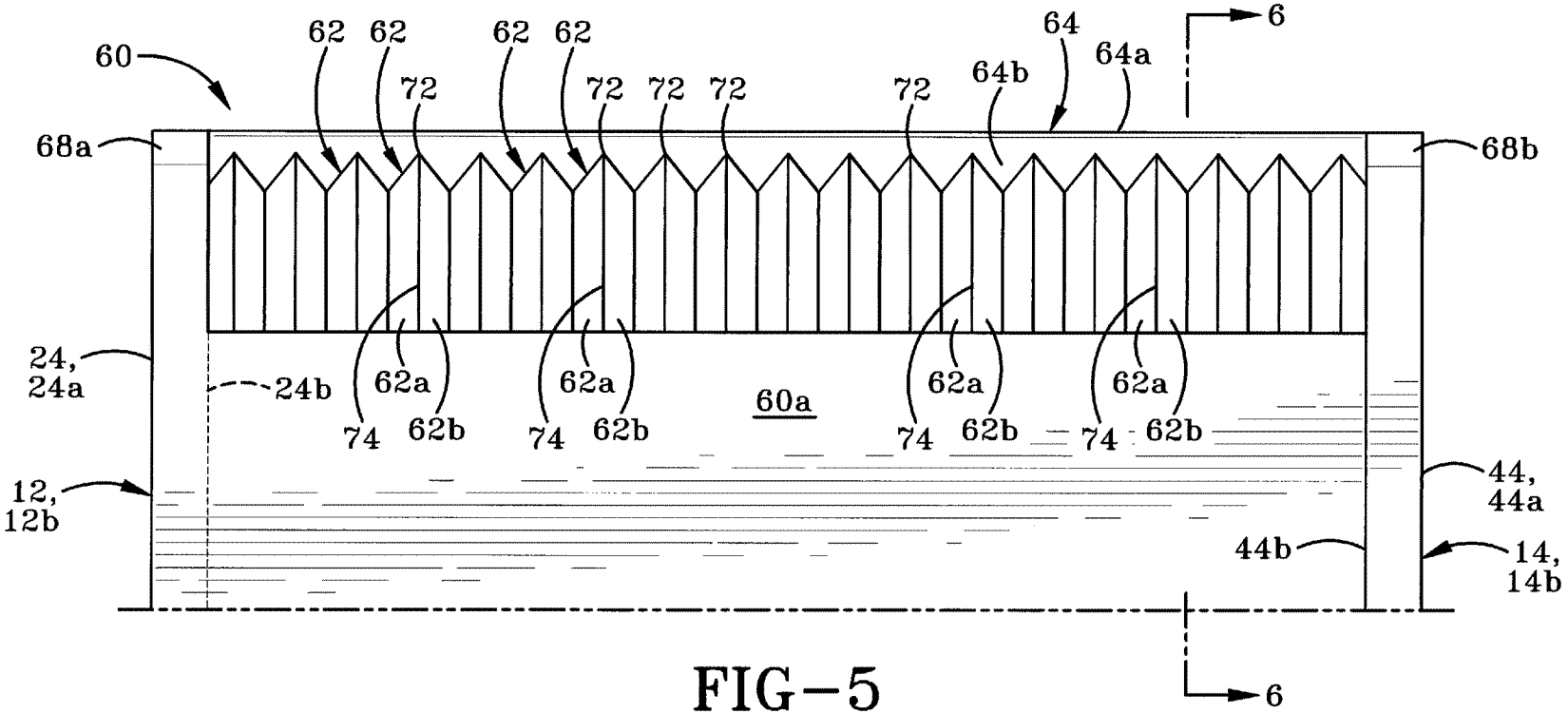
FIG. 5 is a front view of the cutter assembly.
Figure 6:
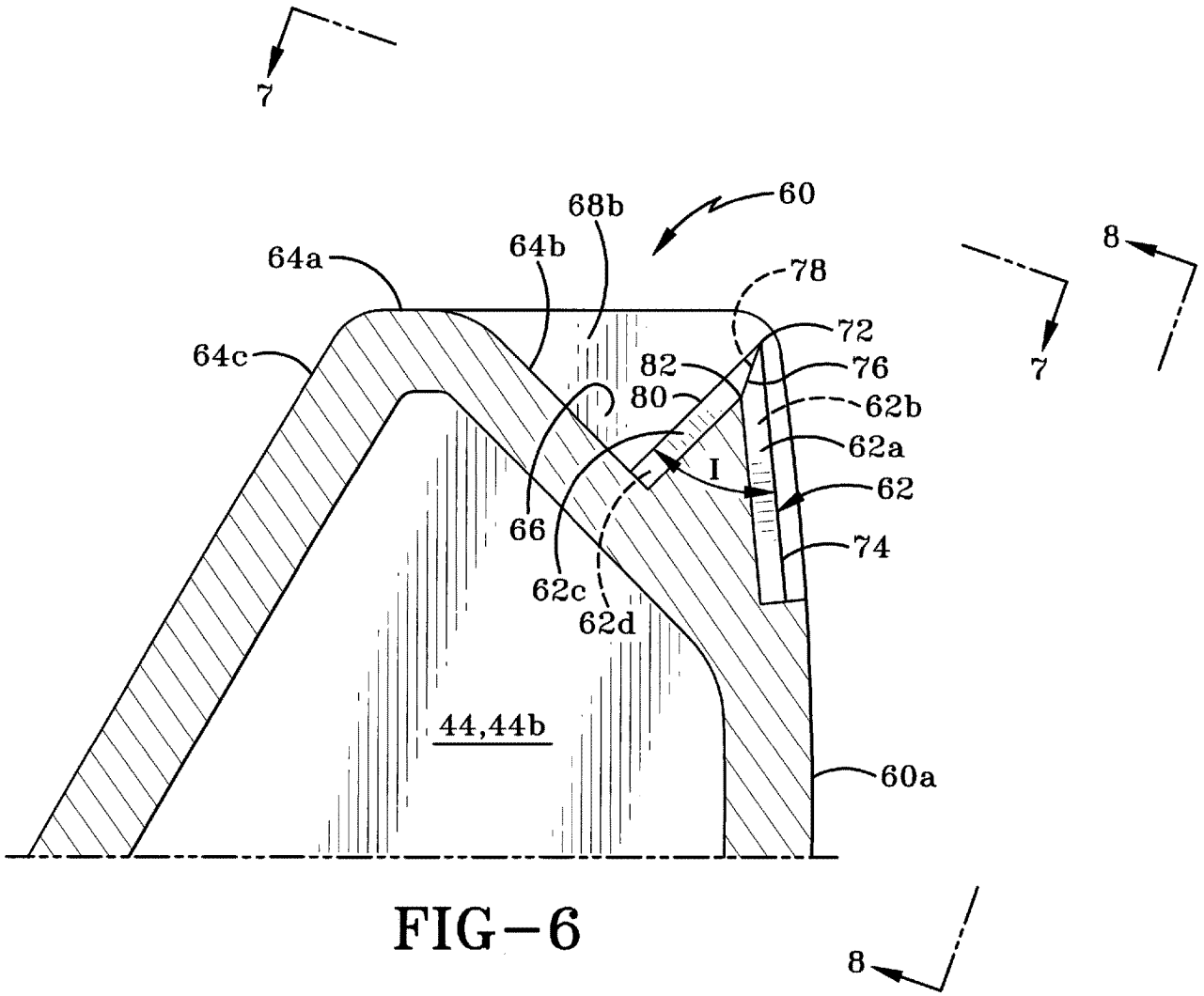
FIG. 6 is a cross-sectional left side view of the cutter assembly taken through line 6-6 of FIG. 5.

Referring to FIGS. 4 & 6, cutter assembly 60 includes a front region 60*a* from which a row of teeth 62 extend upwardly and outwardly. A protrusion 64 is formed on cutter assembly 60 a distance rearwardly from front region 60*a*. Protrusion 64 is a generally inverted V-shape and includes a substantially planar apex region 64*a*, a downwardly sloping front surface 64*b*, and a downwardly sloping rear surface 64*c*. The angled front surface 64*b* causes a valley 66 to be defined between apex region 64*a* and teeth 62. Portions of side walls 24 and 44 extend between apex region 64*a* and teeth and these portions, referenced by characters 68*a*, 68*b* form shields that assist in protecting the user from accidentally cutting themselves on teeth 62 while dispensing tape 22. A plurality of reinforcing members 70 are provided on one or both of the interior surfaces 24*b*, 44*b* of side walls 24, 44. Reinforcing members 70 are provided to stiffen and strengthen the front end of dispenser 10 so that it does not flex or deflect when tape 22 is dispensed from dispenser 10. Reinforcing member(s) 70 on first side member 12 are configured to engage reinforcing member(s) 70 on second side member 14.

As indicated previously, teeth 62 extend upwardly and outwardly from front region 60*a* and the row of teeth 62 extends from the interior surface 24*b* of side wall 24*b* to the interior surface 44*b* of side wall 44*b*. Teeth 62 are spaced a distance in front of apex region 64 and are separated therefrom by valley 66. This valley 66 aids in ensuring that there is adequate room to manipulate tape 22 downwardly for a distance along angled surfaces of teeth 62 as will be hereinafter described in order to sever the tape 22.

In accordance with the present invention, each tooth 62 has a plurality of angled faces that meet at a tip 72. When viewed from above, such as in FIG. 7, each tooth 62 is substantially diamond-shaped. Each tooth has a left front face 62*a*, a right front face 62*b*, a left rear face 62*c* and a right rear face 62*d*. Each of these faces 62*a*, 62*b*, 62*c* and 62*d* lie in a different plane. Left front face 62*a* and right front face 62*b* meet along a front edge 74. Left front face 62*a* and left rear face 62*c* meet along a left side edge 76. Right front face 62*b* and right rear face 62*d* meet along a right side edge 78. Left rear face 62*c* and right rear face 62*d* meet along a rear edge 80. Left and right front faces 62*a*, 62*b* and left and right rear faces 62*c*, 62*d* intersect at tip 72.

Left front face 62*a* extends from front edge 74 to left side edge 76 and is disposed in a first plane. Right front face 62*b* extends from front edge 74 to right side edge 78 and is disposed in a second plane. The first plane is disposed at first angle relative to the second plane and the first and second planes intersect each other along front edge 74. Left rear face 62 extends from left side edge 76 to rear edge 80 and is disposed in a third plane. The third plane is disposed at a second angle relative to the first plane and the third and first planes intersect each other along left side edge 76. The third plane and second plane are substantially parallel to each other and are spaced a distance apart from each other. Right rear face 62*d* extends from right side edge 78 to rear edge 80 and is disposed in a fourth plane. Fourth plane is disposed at the first angle relative to third plane and at the second angle to the second plane. Fourth plane intersects third plane along rear edge 80 and intersects second plane along right side edge 78. Fourth plane and first plane are substantially parallel to each other and are spaced a distance apart from each other. First, second, third and fourth planes intersect each other at an uppermost tip 72 of tooth 62.

In accordance with a specific feature of the present invention, each of left and right side edges 76, 78 preferably is about 1.97 mm long, rear edge 80 preferably is about 1.78 mm long, and front edge 74 preferably is about 2.55 mm long. The total depth of each tooth 62 from the base of front edge 74 in front region 60*a* to the base of rear edge 80 in front surface 64*b* preferably is 2.74 mm. Finally, the distance between the interior surfaces of shields 68*a* and 68*b* preferably is about 23.09 mm.

Figure 7:
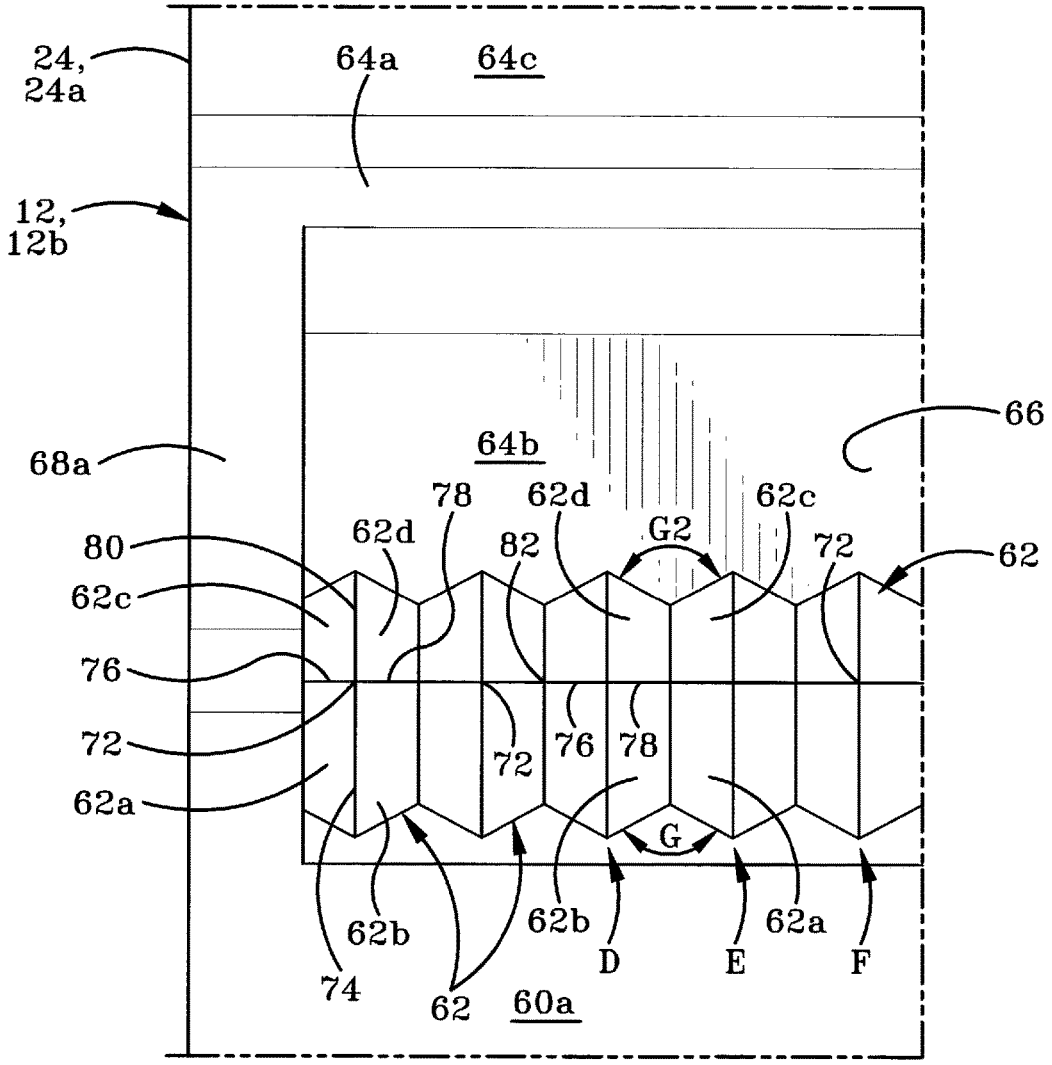
FIG. 7 is a top view of the cutter assembly taken through line 7-7 of FIG. 6.

Referring still to FIG. 7, each tooth 62 in the row of teeth on cutter assembly 60 is substantially identical in configuration and the relationships between the various faces 62*a*-62*d* and the edges 74-80 on a single tooth and the relationships between various components of adjacent teeth in the row of teeth are substantially identical. These relationships will be described with reference to three adjacent teeth in the row, those teeth being referenced as teeth "D", "E" and "F". Right front face 62*b* of first tooth "D" is disposed at a first angle "G" to the left front face 62*a* of second tooth "E". The first angle "G" is between 105° and 115°, and preferably is 110.30°. Right rear face 62*d* of first tooth "D" is disposed at a second angle "G2" relative to left rear face 62*c* of second tooth "E". Second angle "G2" is between 120° and 130° and preferably is 127.26°.

Figure 8:
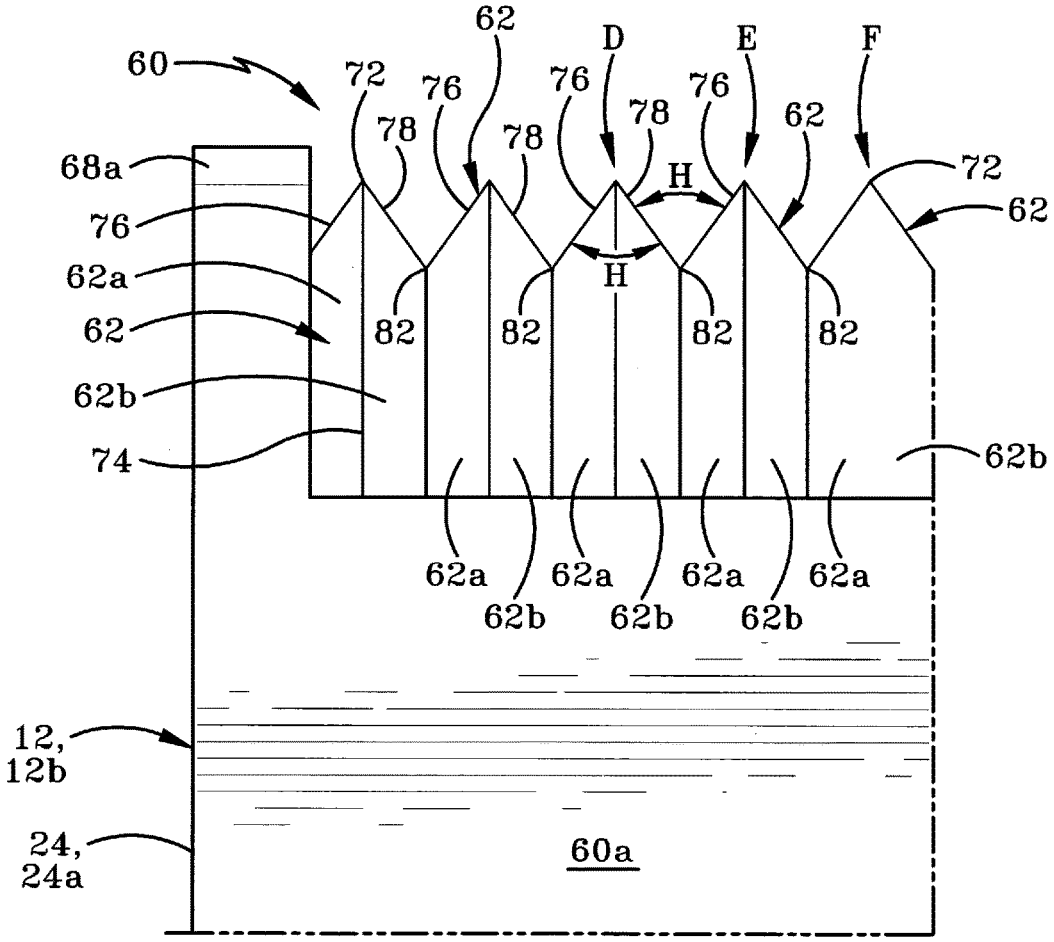
FIG. 8 is a partial front view of the cutter assembly taken through line 8-8 of FIG. 6.

Referring to FIG. 8, left side edge 76 of second tooth "E" is at a third angle "H" relative to right side edge 78 of first tooth "D". The third angle "H" is between 60° and 70° and preferably is 68.4°. Additionally, left side edge 76 of first tooth "D" is at the third angle "H" relative to right side edge 78 of first tooth "D". That third angle "H" is, again, between 60° and 70° and preferably is 68.4°. It should also be noted that right side edge 78 of first tooth "D" meets left side edge 76 of second tooth "E" at a trough 82.

Referring to FIG. 6, front edge 74 is disposed at a fourth angle "I" relative to rear edge 80. Angle "I" is between 45° and 55° and preferably is at 50.9°. The length of rear edge 80 from tip 72 to the point where edge joins front surface 64*b* preferably is 2.55 mm.

Dispenser 10 is used in the following manner. The free end 22*a* (FIG. 1) of tape 22 is grasped and pulled forwardly in the direction of arrow "J" and beyond cutter assembly 60 until the desired length of tape extends between free end 22*a* and teeth 62. When the desired length of tape 22 has been attained, the user applies pressure using their finger and thumb to first and second side members 12, 14 to engage the braking mechanism. As central region 28 is pushed inwardly, hub 20 of roll 18 is engaged by brake spokes 58. Brake spokes 58 cause rotation of roll 18 to cease. A portion of the tape rearwardly of teeth 62 rests on apex region 64*a* of protrusion 64 and adheres slightly thereto. Thus, the application of the braking mechanism in conjunction with the adhesion of tape 22 on protrusion 64 anchors tape 22 in an ideal position to be severed by teeth 62. The length of tape extending beyond teeth 62 is then pulled downwardly in the general direction of arrow "K". This downward movement brings the adhesive underside of tape 22 into contact with tips 72 of teeth 62. Tips 72 perforate tape 22 and as the downward movement continues, the initial perforations are expanded as tape 22 slides down along front, back, left side and right side edges 74-80 to the point that the length of tape is severed from the roll 18. The portion of tape 22 resting on apex region 64*a* remains adhesively engaged with apex region 64*a* and thus is in ideal position for a subsequent dispensing of tape 22 from roll 18.

It will be understood that various modifications may be made to dispenser 10 such as providing cutter assembly 60 on second side member 14 instead of on first side member 12. Such modifications are considered to fall within the scope of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A cutter assembly for a household tape dispenser suitable for cutting Biaxially-Oriented Polypropylene (BOPP) adhesive tape, said cutter assembly comprising:

a base adapted to extend between a first side member and a second side member of a tape dispenser housing; said base having a front region adapted to be disposed at a front end of the tape dispenser; wherein the front region is oriented substantially vertical with respect to a top edge of each of the first and second side members that is located adjacent the base;

a row of plastic teeth extending upwardly and outwardly from the front region the base; wherein the row of teeth includes at least a first tooth, a second tooth and a third tooth, wherein the second tooth is adjacent the first tooth and the third tooth is adjacent the second tooth, and wherein each of the first, second and third teeth includes:

a left front face disposed in a first plane where the first plane is oriented at a first angle relative to the front region of the base;

a right front face disposed in a second plane where the second plane is oriented at a second angle relative to the front region of the base; wherein the left and right front faces meet along a single central front edge and the first plane is angled relative to the second plane; and the front edge extends upwardly from the front region of the base and each of the left and right front faces angles rearwardly away from the front edge;

a left rear face disposed in a third plane; and a right rear face disposed in a fourth plane; and wherein the left and right rear faces are angled relative to each other and meet along a single central rear edge and wherein the third and fourth planes are angled relative to each other and the left and right rear faces angle forwardly away from the rear edge; and wherein the rear edge is opposite the front edge; and wherein the first, second, third and fourth planes intersect each other at a discrete point and which point forms an uppermost tip of the tooth; and wherein a length of the central rear edge is shorter than a length of the central front edge; and a protrusion formed on the base a spaced distance rearwardly of the row of teeth.

2. The cutter assembly as defined in claim 1, wherein the protrusion is a generally inverted V-shape.

3. The cutter assembly as defined in claim 1, wherein the protrusion has an apex region disposed substantially on a same plane as the tips of the teeth.

4. The cutter assembly as defined in claim 3, wherein the protrusion further includes a front surface angling downwardly from the apex region and toward the row of teeth.

5. The cutter assembly as defined in claim 4, further comprising a valley defined between the apex region and the row of teeth.

6. The cutter assembly as defined in claim 3, wherein the protrusion further includes a rear surface angling downwardly and rearwardly away from the apex region.

7. The cutter assembly as defined in claim 3, wherein the apex region is generally planar.

8. A household tape dispenser for dispensing Biaxially-Oriented Polypropylene (BOPP) adhesive tape; said tape dispenser comprising:

a first side member having a first axle portion extending outwardly from an interior surface thereof;

a second side member having a second axle portion extending outwardly from an interior surface thereof, and wherein the first and second side members are engageable with each other and when so engaged, the first and second axle portions are adapted to support a hub of a roll of BOPP tape thereon such that the roll of tape is rotatable about an axis extending through the first and second axle portions;

a cutter assembly provided on a front end of the dispenser a spaced distance forwardly from the first and second axle portions; said cutter assembly including: a base extending between the first and second side members and having a front region oriented substantially vertical with respect to a top edge of each of the first and second side members, wherein the top edges are located adjacent the base; a row of plastic teeth adapted to perforate the BOPP tape and sever a desired length of the tape from the roll; wherein the row of teeth extends upwardly from the front region and includes at least a first tooth, a second tooth and a third tooth, wherein the second tooth is adjacent the first tooth and the third tooth is adjacent the second tooth, and wherein each of the first, second and third teeth includes:

a left front face disposed in a first plane where the first plane is oriented at a first angle relative to the front region of the base;

a right front face disposed in a second plane where the second plane is oriented at a second angle relative to the front region of the base; wherein the left and right front faces meet along a single central front edge and the first plane is angled relative to the second plane; and the front edge extends upwardly from the front region of the base and each of the left and right front faces angles rearwardly away from the front edge;

a left rear face disposed in a third plane; and a right rear face disposed in a fourth plane; and wherein the left and right rear faces are angled relative to each other and meet along a single central rear edge and wherein the third and fourth planes are angled relative to each other and the left and right rear faces angle forwardly away from the rear edge; and wherein the rear edge is opposite the front edge; and wherein the first, second, third and fourth planes intersect each other at a discrete point and which point forms an uppermost tip of the tooth; and wherein a length of the central rear edge is shorter than a length of the central front edge; and a protrusion formed on the front end of the dispenser rearwardly of the row of teeth and forwardly of the first and second axle portions.

9. The tape dispenser as defined in claim 8, wherein said protrusion has an apex region disposed substantially on a same plane as the tips of the row of teeth; and wherein the apex region is adapted to support a portion of the tape disposed rearwardly of a tape region being severed by the row of teeth.

10. The tape dispenser as defined in claim 9, wherein the protrusion further includes a front surface angling downwardly from the apex region and toward the row of teeth.

11. The tape dispenser as defined in claim 10, further comprising a valley defined between the apex region and the row of teeth.

12. The tape dispenser as defined in claim 10, wherein the apex region is generally planar.

13. In combination, a roll of Biaxially-Oriented Polypropylene (BOPP) adhesive tape, wherein the roll includes a cylindrical hub with an extended length of BOPP tape wound thereon;

a tape dispenser for retaining the roll of BOPP tape therein and for selectively dispensing desired lengths of tape therefrom, wherein said tape dispenser comprises:

a first side member having an interior surface;

a first axle portion extending outwardly from the interior surface;

a second side member having an interior surface;

a second axle portion extending outwardly from the interior surface of the second side member, wherein the first and second side members are engageable with each other and when so engaged the first and second axle portions are engaged with each other and the roll of tape is received thereon and is rotatable about an axis extending through the first and second axle portions; and a cutter assembly provided on a front end of the dispenser and extending between the interior surfaces of the first and second side members; said cutter assembly including: a base extending between the first and second side members and having a front region oriented substantially vertical with respect to a top edge of each of the first and second side members, wherein the top edges are located adjacent the base; a row of plastic teeth extending upwardly from the front region, each tooth having a tip configured to perforate the BOPP tape and wherein the teeth are adapted sever a desired length of the tape from the roll; and wherein the row of teeth includes at least a first tooth, a second tooth and a third tooth, wherein the second tooth is adjacent the first tooth and the third tooth is adjacent the second tooth, and wherein each of the first, second and third teeth includes:

a left front face disposed in a first plane where the first plane is oriented at a first angle relative to the front region of the base;

a right front face disposed in a second plane where the second plane is oriented at a second angle relative to the front region of the base; wherein the left and right front faces meet along a single central front edge and the first plane is angled relative to the second plane; and the front edge extends upwardly from the front region of the base and each of the left and right front faces angles rearwardly away from the front edge;

a left rear face disposed in a third plane; and a right rear face disposed in a fourth plane; and wherein the left and right rear faces are angled relative to each other and meet along a single central rear edge and wherein the third and fourth planes are angled relative to each other and the left and right rear faces angle forwardly away from the rear edge; and wherein the rear edge is opposite the front edge; and wherein the first, second, third and fourth planes intersect each other at a discrete point and which point forms an uppermost tip of the tooth; and wherein a length of the central rear edge is shorter than a length of the central front edge;

a protrusion formed on the front end of the dispenser rearwardly of the row of teeth and forwardly of the first and second axle portions.

14. The combination as defined in claim 13, wherein the protrusion has an apex region disposed substantially on a same plane as the tips of the row of teeth.

15. The combination as defined in claim 14, wherein the protrusion further includes a front surface angling downwardly from the apex region and toward the row of teeth.

16. The combination as defined in claim 14, where in the protrusion further includes a valley defined between the apex region and the row of teeth; and wherein the apex region supports a portion of the tape disposed rearwardly of a tape region being severed by the teeth.

17. The combination as defined in claim 14, wherein the apex region is generally planar.

18. The combination as defined in claim 13, wherein the protrusion is a generally inverted V-shape.

19. The combination as defined in claim 14, wherein the protrusion further includes a rear surface angling downwardly and rearwardly away from the apex region; and wherein the apex region is generally planar.

* * * * *